United States Patent [19]

Swanson

[11] 3,957,132

[45] May 18, 1976

[54] SNOWMOBILE MUFFLER

[75] Inventor: Ian N. Swanson, Eagan, Minn.

[73] Assignee: Donaldson Company, Inc., Minneapolis, Minn.

[22] Filed: Dec. 9, 1974

[21] Appl. No.: 530,675

[52] U.S. Cl. ..... 181/57; 181/35 B; 181/60

[51] Int. Cl.[2] ..... F01N 1/08

[58] Field of Search ..... 181/35 B, 35 C, 46, 181/55, 56, 57, 58, 60, 49

[56] References Cited

UNITED STATES PATENTS

| | | | |
|---|---|---|---|
| 310,654 | 1/1885 | DeWitt | 181/60 X |
| 773,984 | 11/1904 | Richard | 181/60 X |
| 2,507,336 | 5/1950 | Golliez | 181/46 |
| 2,644,542 | 7/1953 | Bourne | 181/60 X |

FOREIGN PATENTS OR APPLICATIONS

| | | | |
|---|---|---|---|
| 418,512 | 10/1934 | United Kingdom | 181/49 |
| 348,642 | 2/1905 | France | 181/56 |
| 998,195 | 9/1951 | France | 181/60 |

*Primary Examiner*—John Gonzales
*Attorney, Agent, or Firm*—Merchant, Gould, Smith & Edell

[57] ABSTRACT

An improved muffler for snowmobiles having multiple stages including at least one radial tubular attenuator comprising one or more flat, two-part casings, the parts being peripherally identical and configured to jointly form a plurality of passages, having bell-mouth inlets and diffuser outlets, communicating with a common central cavity. In a first embodiment, the engine exhaust is conducted axially to the central cavity and the plural passages discharge into a muffler chamber to comprise the first of several muffler attenuating stages. In a second embodiment, the engine exhaust is supplied radially. Another embodiment shows a pair of the radial tubular attenuators connected serially, the gas flow in the two sets of radial passages being in opposite directions and a second chamber being interposed between the two. A still further embodiment shows a pair of the casings jointly fed centrally with the engine exhaust.

8 Claims, 7 Drawing Figures

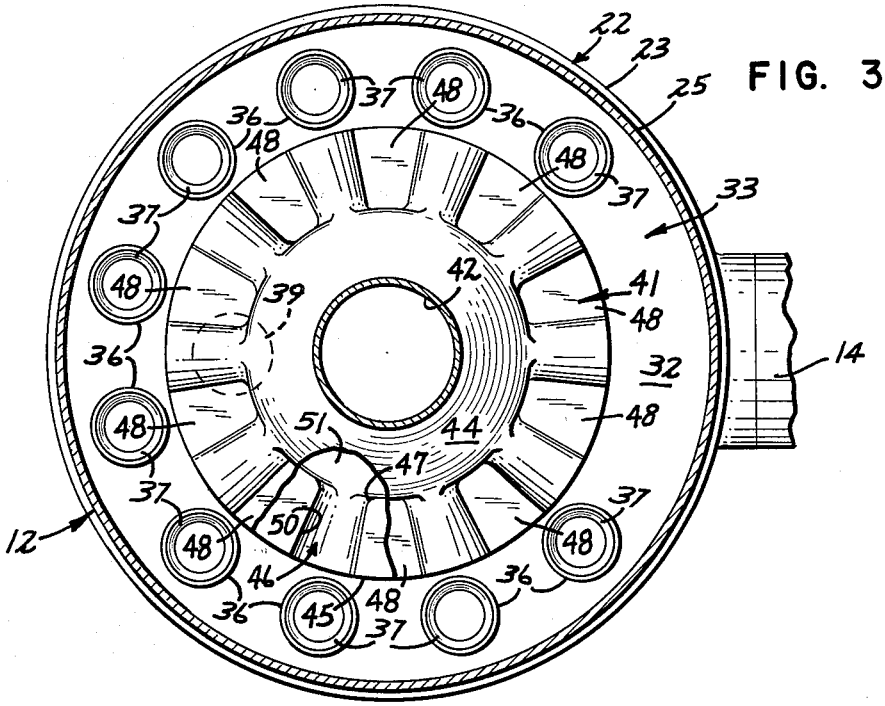
FIG. 3
FIG. 4
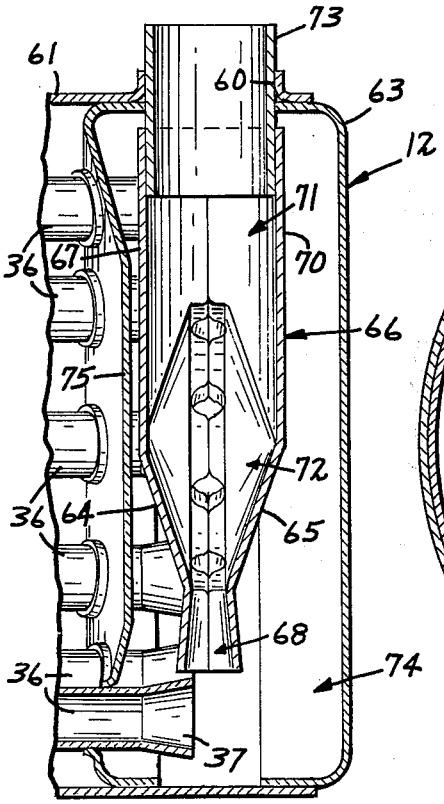
FIG. 5
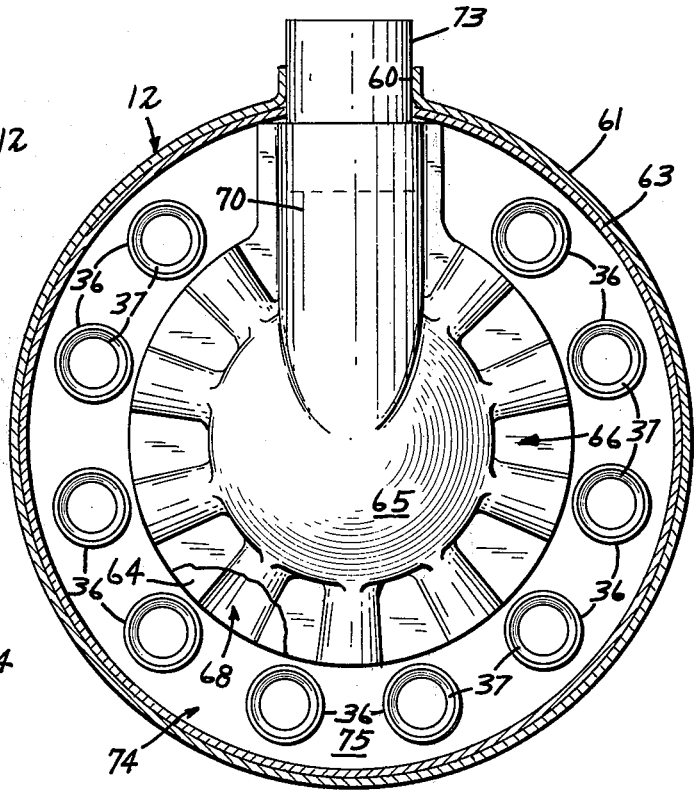

SNOWMOBILE MUFFLER

BACKGROUND OF THE INVENTION

This invention relates to the field of exhaust systems for internal combustion engines, and particularly to mufflers of compact configuration and high acoustical efficiency. The advent of equipment powered by small gasoline engines, such for example as snowmobiles, has produced or emphasized the need for reducing the "sound pollution" produced by these engines, within the space and cost limitations unavoidable in such applications.

It has long been known that the noise produced in the operation of internal combustion engines and appearing as the acoustical energy component of the engine exhaust can be reduced or attenuated to almost any level desired, if cost and space constraints are ignored. The art of mufflers is a well-worked one, and numerous sound attenuating expedients are known. A common example is the use of concentric perforated tubes through which the exhaust gases must pass, and its equivalent is found in mufflers where the gases must pass through bodies of material such as glass wool. An alternative method has been to pass the gases through a set of tubes in a re-entrant path whereby destructive interference of the sound energy in selected frequency bands takes place.

Mufflers of the first type are characterized by a tendency to become plugged, and also present so high a loss coefficient that a large area of material for gas flow must be provided, which means that the dimensions of the unit become undesirably large. The wave lengths of the sounds to be attenuated also dictate a muffler structure of undesirably large dimensions, if the alternative method is to be used.

It is customary in muffler design to incorporate within a single housing a plurality of attenuators, sometimes tuned for different acoustical frequencies. One of the most efficient expedients is to use orifices having bell-mouth inlets or adits and diffuser outlets or exits. Here again, the dimensions required for an attenuator capable of effective use to pass the volume of gas exhausted by commercially successful engines is prohibitive. The most use heretofore made of this principal has been to make bell-mouthed the inlets of the perforations in the type of muffler first referred to above.

SUMMARY OF THE INVENTION

The present invention comprises a structure in which the efficient orifice described above may be used in mufflers of acceptably small dimensions. Instead of trying to accomplish the desired result in a single orifice extending longitudinally of a muffler housing, I have invented a radial tubular attenuator in which a plurality of such orifices, each by itself of acceptable dimensions, are arranged radially within a housing, to have a tolerable overall flow loss coefficient. I have found that one or two such attenuators, in combination with other known attenuators if desired, result in a multiple stage muffler which is sturdy, long lasting, compact, and highly efficient. My attenuators may be used together either sequentially or concurrently, and may preceed, interconnect, or follow other attenuators.

Various characteristics, advantages, and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing,

FIG. 3 is a transverse sectional view taken along the line 3—3 of FIG. 1, FIGS. 4 and 5 are a fragmentary longitudinal section, and a transverse section similar to FIGS. 2 and 3 respectfully, of a second embodiment of the invention.

DESCRIPTION OF THE PREFERRED EMBODIMENTS

Figure 1:
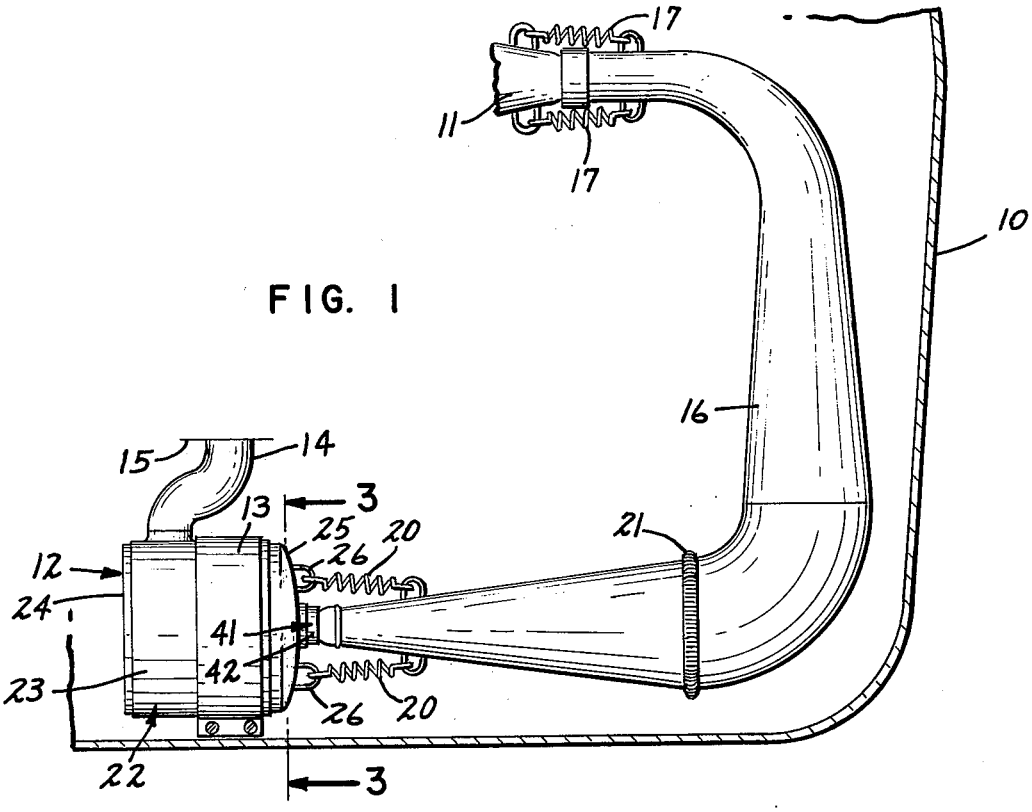
FIG. 1 is a schematic showing in plan of a muffler according to the invention, installed in the engine compartment of a snowmobile.

Referring now to FIG. 1, reference numeral 10 identifies the engine compartment of a snowmobile, in which the exhaust manifold of the engine is shown at 11. A muffler 12 is mounted solidly in compartment 10 by suitable means such as a clamping band 13, and a tailpipe 14 is connected from the muffler outlet to discharge into the snowmobile tunnel 15. A tuned exhaust pipe 16 conducts the exhaust gases from the engine to the muffler: it is connected to the engine by springs 17 and to the muffler by springs 20, and is supported in compartment 10 by a spring 21, since the engine is flexibly mounted in the compartment and moves considerably as it operates. As is known, exhaust pipe 16 is dimensioned to attenuate some of the lower frequency acoustical components of the exhaust gases before they reach muffler 12.

Figure 2:
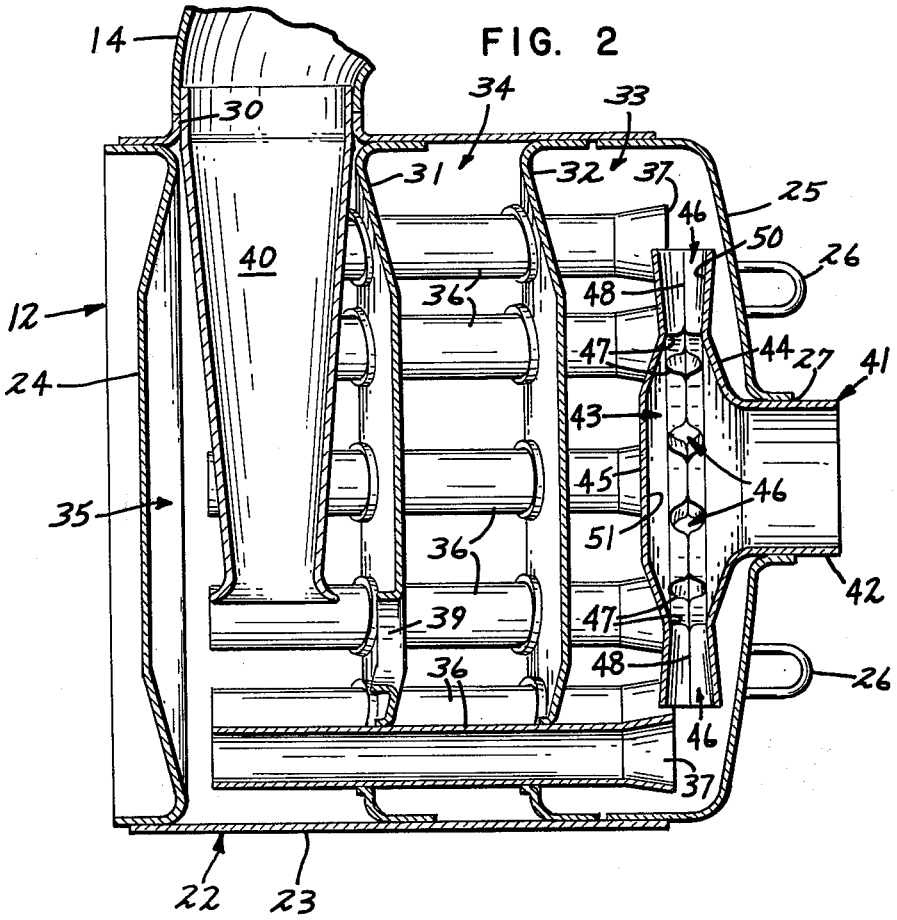
FIG. 2 is a horizontal longitudinal section of a first embodiment of the invention.

A first embodiment of muffler 12 is shown in FIGS. 2 and 3 to comprise a generally cylindrical housing 22 having a side wall 23 sealed to end headers 24 and 25, the latter being provided with eyes 26 for receiving springs 17 of FIG. 2. Header 25 includes a central, axially directed adit or inlet aperture 27, and wall 23 includes a generally radially directed exit or outlet aperture 30. The housing is divided by partitions 31 and 32 into first, second and third chambers 33, 34 and 35 respectively. Communication between chambers 33 and 35 is by a plurality of tubes 36 passing through and sealed in apertures in partitions 31 and 32, and arranged near the wall of the housing. Tubes 36 preferrably include converging conical inlet portions 37. Communication between chambers 34 and 35 is provided by an aperture 39 in partition 31, so that chamber 34 may act as a Helmholtz resonator tuned to absorb some of the acoustical energy in chamber 35. An output nozzle 40 is contained in chamber 35 and projects through opening 30 to comprise the outlet connection for the muffler, to which tailpipe 14 is connected.

My radial tubular attenuator is identified by the reference numeral 41, and is mounted within chamber 33 by an inlet conduit 42 received in aperture 27. Attenuator 41 is a hollow casing 43 made of two peripherally identical portions 44 and 45, the former centrally configured to comprise inlet conduit 42, and the latter being centrally imperforate. Around their peripheries members 44 and 45 are formed to jointly define a plurality of tubular passages 46, and they are secured together between these passages as at 48 in any suitable manner as by welding. Each of passages 46 is configured to provide a bell-mouth inlet 47 and a diffuser outlet 50, and the total area of these passages is not so small as to constitute the limiting restriction on gas flow through the muffler. Such attenuators are especially useful when designed for the high frequency bands of acoustical energy.

The flow path of gases through the muffler is axial through inlet 42 into central cavity 51 of casing 43, thence radially outward through passages 46 into chamber 33, thence axially through tubes 36 into chamber 35, and thence radially through nozzle 40 to tailpipe 14. It is to be noted that the number of tubes 36 is not necessarily the same as the number of passages 46. By preference the inner nozzle 40 terminates close to aperture 37.

Stated differently, the muffler comprises a four stage device, attenuator 41 being the first stage, tubes 36 being the second stage, chamber 35 with chamber 34 as a resonator therefore being the third stage, and nozzle 40 being the fourth stage.

A second embodiment of the invention, shown in FIGS. 4 and 5, differs from that just described in the manner in which the engine exhaust gases are supplied to the muffler. Here the input aperture 60 is provided in the side wall 61 of the housing 62 rather than in header 63, which is imperforate, and the two portions 64 and 65 of attenuator casing 66 are completely identical, neither one having a central aperture. Instead they are peripherally formed as at 67, 70 to jointly define a large channel 71 leading radially to the central cavity 72 of the casing, and channel 71 is continued through aperture 60 by a nipple 73 to comprise the muffler inlet. Casing 66 is contained in a chamber 74 delimited by partition 75 which, like partition 32 in FIG. 2, is penetrated by tubes 36 sealed therein. Also, attenuator 66 is provided with passages 68, formed similarly to passages 46 of attenuator 41. Passages 68 are disposed adjacent the inlet portions 37 of tubes 36 like passages 46.

Figure 6:
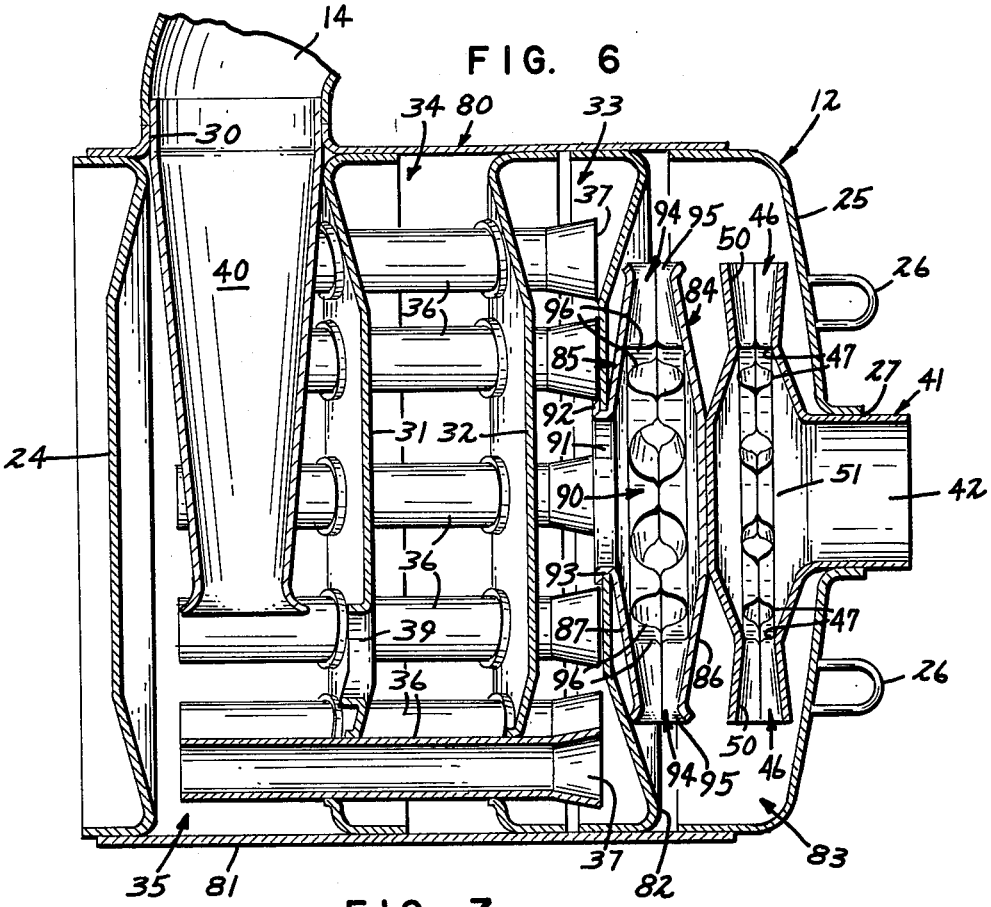
FIG. 6 is a sectional view like FIG. 2 of a third embodiment of the invention.

FIG. 6 shows a modification of the structure of FIG. 2: like elements in the two figures have been given the same reference numerals. Housing 80 of this embodiment has a slightly longer sidewall 81, and contains an additional partition 82 to define with header 25 an additional chamber 83. Chamber 83 contains attenuator 41, which receives the engine exhaust gases at 42 and which discharges through passages 46 into the chamber. A second attenuator 84 comprises a casing 85 made up of two portions 86 and 87, enclosing a central cavity 90. Portion 86 is centrally imperforate, and is secured to portion 87 of casing 84. Portion 87 is centrally apertured at 91 and has a rim 92 which is turned over the edge of a like central aperture 93 in partition 82.

Peripherally, portions 86 and 87 of casing 85 are formed to jointly define a plurality of tubular passages 94. Although generally like passages 46 in attenuator 41, the passages 94 in attenuator 84 are oppositely configured, to have external bell-mouth openings 95 and internal diffusers 96.

The flow of gas through this modification of the invention is as follows. Entering axially at 42, the gas flows radially outwardly through passages 46 into chamber 83, radially inwardly through passages 94 into casing 85, and then axially through apertures 91 and 93 into chamber 33, the flow thereafter being as traced in connection with FIG. 2.

It will be evident that in this embodiment of the invention there are two initial stages of radial tubular attenuation encountered sequentially by the exhaust gases. However, when two such attenuators are used, it is not required that they be directly sequential, or tuned to the same frequency, or that they be the initial stages of the muffler: other forms of attenuator stages may be interposed between, or may preceed, any radial tubular attenuator stage.

Figure 7:
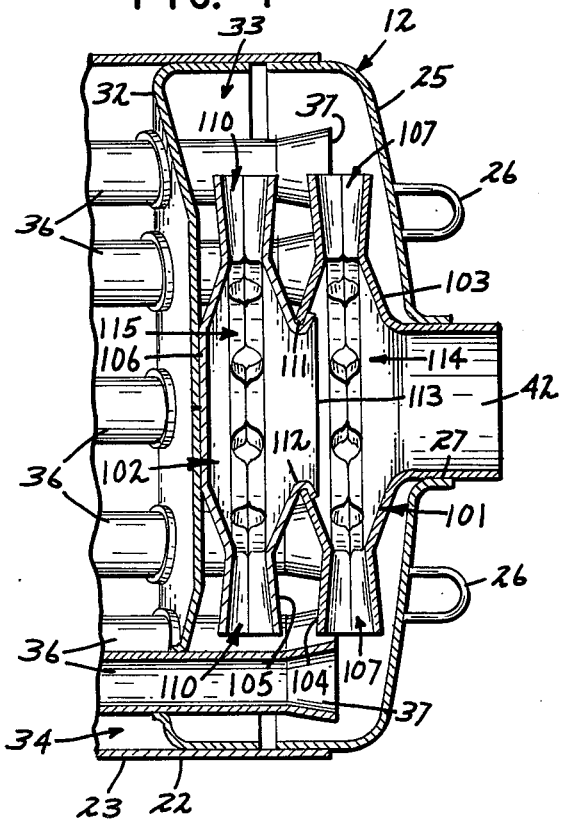
FIG. 7 is a fragmentary sectional view generally like FIG. 4 but showing a further embodiment of the invention.

FIG. 7 shows a still further modification of the invention used to further reduce the restriction produced by an attenutator according to FIG. 2. In FIG. 7, chamber 33 contains two attenuator casings 101 and 102 made up of portions 103, 104 and 105, 106 to define passages 107 and 110, all respectively. Portion 103 is formed centrally to provide inlet 42. Portion 106 is centrally imperforate. Portions 104 and 105 are centrally apertured at 111 and 112, and portion 105 is turned over at 113 to sealingly engage aperture 111. The two casings thus have central cavities 114 and 115 in communication, so as to double the passage area for flow of gases into chamber 33, and hence to reduce the back pressure presented by this portion of the muffler.

From the foregoing, it will be evident that I have invented an improved muffler, and an improved attenuator for use in mufflers generally. My arrangement is compact, efficient, and relatively inexpensive to manufacture, and is particularly useful in muffler applications where small dimensions, ruggedness, and economy are controlling factors.

Numerous characteristics and advantages of my invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principal of the invention, to the full extent indicated by the broad general meaning of the terms in which the appended claims are expressed.

What is claimed is:

1. In a muffler, in combination:

a housing having a longitudinal axis;

partition means defining with said housing at least one distinct chamber;

means for conducting gases from said chamber;

and means including a radial tubular attenuator for connecting said chamber to a source of traveling fluid having a content of acoustical energy, said means comprising a pair of flat casings contained within a second chamber;

one of said casings having at least one passage for admitting thereto fluids from said source, and a plurality of generally coplanar radially directed passages for providing outward egress of fluids therefrom into said second chamber;

another of said casings having at least one passage for providing egress of fluids therefrom into said one chamber, and a plurality of generally coplanar radially directed passages for admitting fluid thereto from said second chamber.

2. Apparatus according to claim 1 in which each of the passages of each of said pluralities thereof comprises a bell-mouth adit and a diffuser exit.

3. A radial tubular attenuator comprising a pair of peripherally identical sections secured together to jointly define a plurality of tubular passages extending radially from a central cavity, each of said passages being configured with an initial bell-mouth and a subsequent diffuser, at least one of said sections further including an input aperture.

4. Apparatus according to claim 3 in which said input aperture is axial.

5. Apparatus according to claim 3 in which said input aperture is radial and is formed in part in each of said sections.

6. Apparatus according to claim 3 in which said bell-mouths are located radially outwardly of said diffusers.

7. Apparatus according to claim 3 in which said bell-mouths are located radially inwardly of said diffusers.

8. Apparatus according to claim 3 in which the axes of all said passages are substantially coplanar.

* * * * *